US009422031B2

(12) United States Patent
Roncarolo

(10) Patent No.: US 9,422,031 B2
(45) Date of Patent: Aug. 23, 2016

(54) LATCHING DEVICE FOR A MOVABLE PLATFORM

(71) Applicant: OPACMARE S.r.l., Rivalta di Torino, Turin (IT)

(72) Inventor: Davide Roncarolo, Turin (IT)

(73) Assignee: OPACMARE S.r.l., Turin (IT)

( * ) Notice: Subject to any disclaimer, the term of this patent is extended or adjusted under 35 U.S.C. 154(b) by 0 days.

(21) Appl. No.: 14/805,235

(22) Filed: Jul. 21, 2015

(65) Prior Publication Data

US 2016/0023719 A1 Jan. 28, 2016

(30) Foreign Application Priority Data

Jul. 25, 2014 (IT) ..... TO2014A0594

(51) Int. Cl.

| | |
|---|---|
| ***B63B 17/00*** | (2006.01) |
| ***B63B 27/14*** | (2006.01) |
| ***B63B 23/40*** | (2006.01) |
| ***B63B 27/16*** | (2006.01) |

(52) U.S. Cl.

CPC ..... *B63B 17/00* (2013.01); *B63B 23/40* (2013.01); *B63B 27/14* (2013.01); *B63B 27/16* (2013.01)

(58) Field of Classification Search

CPC ..... B63B 17/00; B63B 17/04; B63B 23/40; B63B 27/14; B63B 27/16

USPC ..... 114/343, 362, 363

See application file for complete search history.

(56) References Cited

U.S. PATENT DOCUMENTS 7,341,016 B2 * 3/2008 Terleski ..... B63B 27/143 114/343

7,946,243 B1 * 5/2011 Ulrich ..... B63B 27/16 114/362

FOREIGN PATENT DOCUMENTS

DE 20 2009 007 141 U1 8/2009

OTHER PUBLICATIONS

International Search Report for Italian Patent Application No. TO2014A000594 dated Mar. 20, 2015.

* cited by examiner

*Primary Examiner* — Lars A Olson

(74) *Attorney, Agent, or Firm* — Arent Fox LLP

(57) ABSTRACT

A movable platform structure including a base structure, a platform and an articulated system which connects the platform to the base structure, wherein the platform is movable between a raised position which is horizontally adjacent to the base structure and a lowered position which is horizontally far from the base structure. The platform assembly further includes a latching device switchable into a stable locking position for locking the platform against the base structure when the platform is in the raised position.

6 Claims, 5 Drawing Sheets

LATCHING DEVICE FOR A MOVABLE PLATFORM

CROSS-REFERENCE TO RELATED APPLICATIONS

This application is based upon and claims the benefit of priority to Italian Patent Application No. TO2014A000594, filed Jul. 25, 2014. The disclosure of the prior application is hereby incorporated in its entirety by reference.

FIELD OF THE INVENTION

The present invention relates in general to movable platform assemblies, of the type comprising a base structure, a platform and an articulated system which connects the platform to the base structure, wherein the platform is movable between a raised position which is horizontally adjacent to the base structure and a lowered position which is horizontally far from the base structure.

BACKGROUND OF THE INVENTION

These assemblies are generally mounted on boats and are used to allow hauling and launching of a tender or similar type of marine vehicle with which the boat is equipped or for allowing swimmers to access the water.

Operation of the platform assemblies is usually performed by means of hydraulic or electrical devices. When the platform is in the raised position adjacent to the base structure, the actuating system which should ensure the stability thereof nevertheless has a certain amount of play such that, when a load of a certain size is mounted on the platform, the latter may lower slightly, creating a certain gap between the platform and base structure.

SUMMARY OF THE INVENTION

One object of the present invention is therefore to propose a platform assembly configured to overcome this drawback.

The aforementioned object is achieved according to the invention by a movable platform assembly of the type defined initially which also includes a latching device switchable into a stable locking position for locking the platform against the base structure when the platform is in the raised position, wherein the latching device comprises a striker element fixed to the platform, a movable latching element arranged on the base structure for engaging the striker element so as to lock the platform, and an actuating mechanism for actuating the latching element, wherein a force applied on the platform when the latching device is in the locking position and tending to horizontally move the platform away from the base structure causes the actuating mechanism of the latching device to be blocked, wherein the latching element is arranged rotatably about a rotation axis, wherein the actuating mechanism comprises an articulated quadrilateral formed by a frame element fixed to the base structure, an actuating lever hinged with the frame element, the latching element hinged with the frame element, and a link member hinged, at opposite ends, with an intermediate point of the latching element and with an intermediate point of the actuating lever, respectively, wherein when the latching device is in the locking position the hinge points between frame element and actuating lever, between actuating lever and link member, and between link member and latching element lie on a same straight line coinciding with the instantaneous direction of movement of the hinge point between latching element and link member.

Preferred embodiments of the invention are defined in the dependent claims which form an integral part of the present description.

BRIEF DESCRIPTION OF THE DRAWINGS

Further characteristic features and advantages of the present invention will become clear from the following detailed description provided purely by way of a non-limiting example, with reference to the accompanying drawings in which.

DESCRIPTION OF THE PREFERRED EMBODIMENTS

Figure 1:
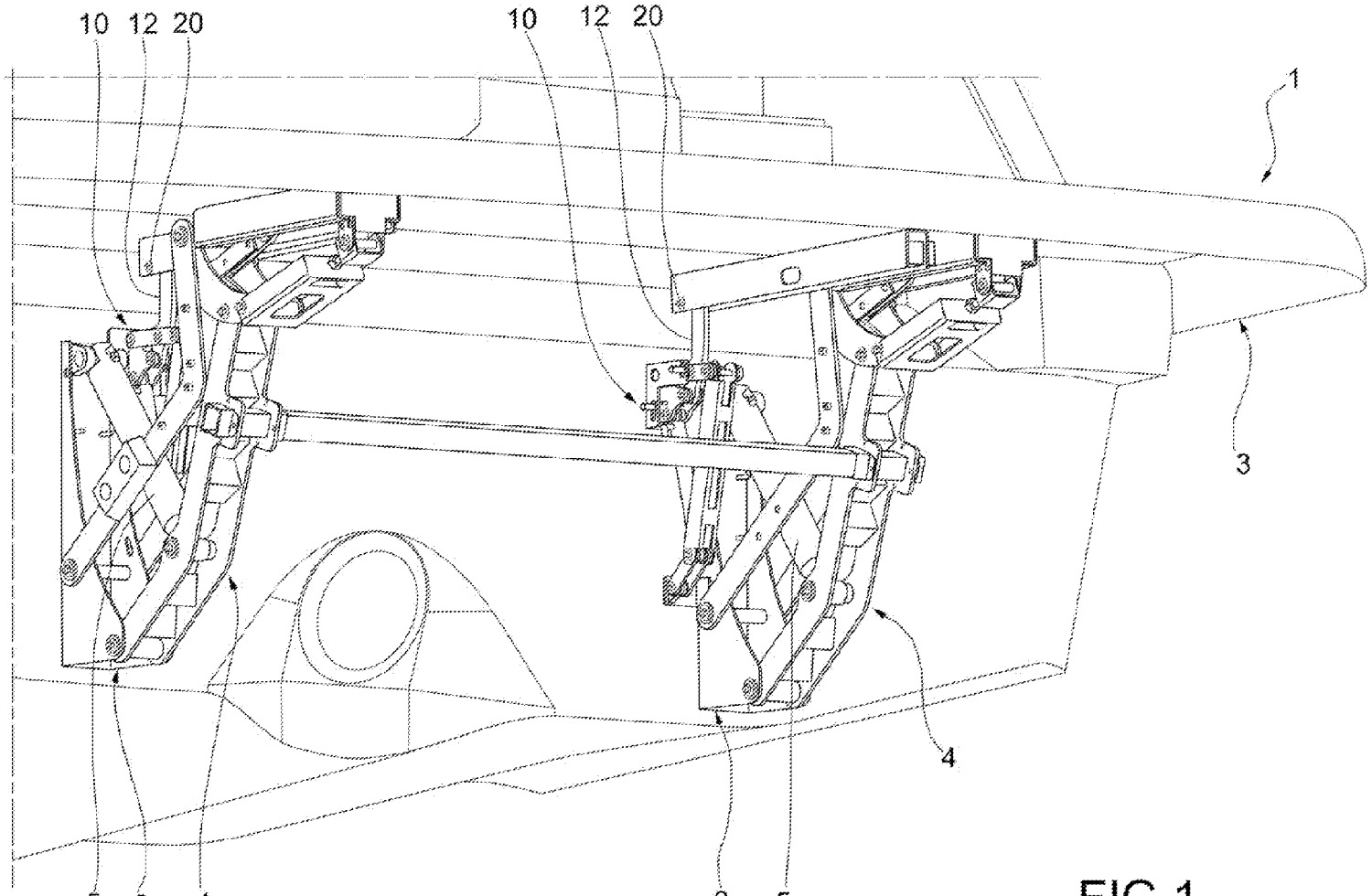
FIG. 1 is a perspective view which shows a movable platform assembly provided with a latching device according to the invention.

With reference to FIG. 1, this figure shows a platform assembly 1 according to the invention, installed on a boat. More generally, the invention relates to different platform assemblies installed on a fixed structure or on a vehicle.

The platform assembly 1 comprises a base structure 2 with which a platform 3 is articulated. The base structure 2 may be provided with means (not shown) for allowing fixing of the assembly 1 to the fixed structure or vehicle or, in an alternative embodiment, may be incorporated in the fixed structure or in the vehicle.

The assembly 1 also comprises an articulated system 4 which is formed by a plurality of bars hinged together and, by means of these bars, connects the platform 3 to the base structure 2. Also associated with the articulated system 4 is an actuator 5 by means of which the platform 3 is movable between a raised position which is horizontally adjacent to the base structure 2 (shown in FIG. 1) and a lowered position which is horizontally far from the base structure 2.

According to the invention, the assembly includes a latching device 10 for locking the platform 3 against the base structure 2 when the platform 3 is in the raised position.

Figure 2:
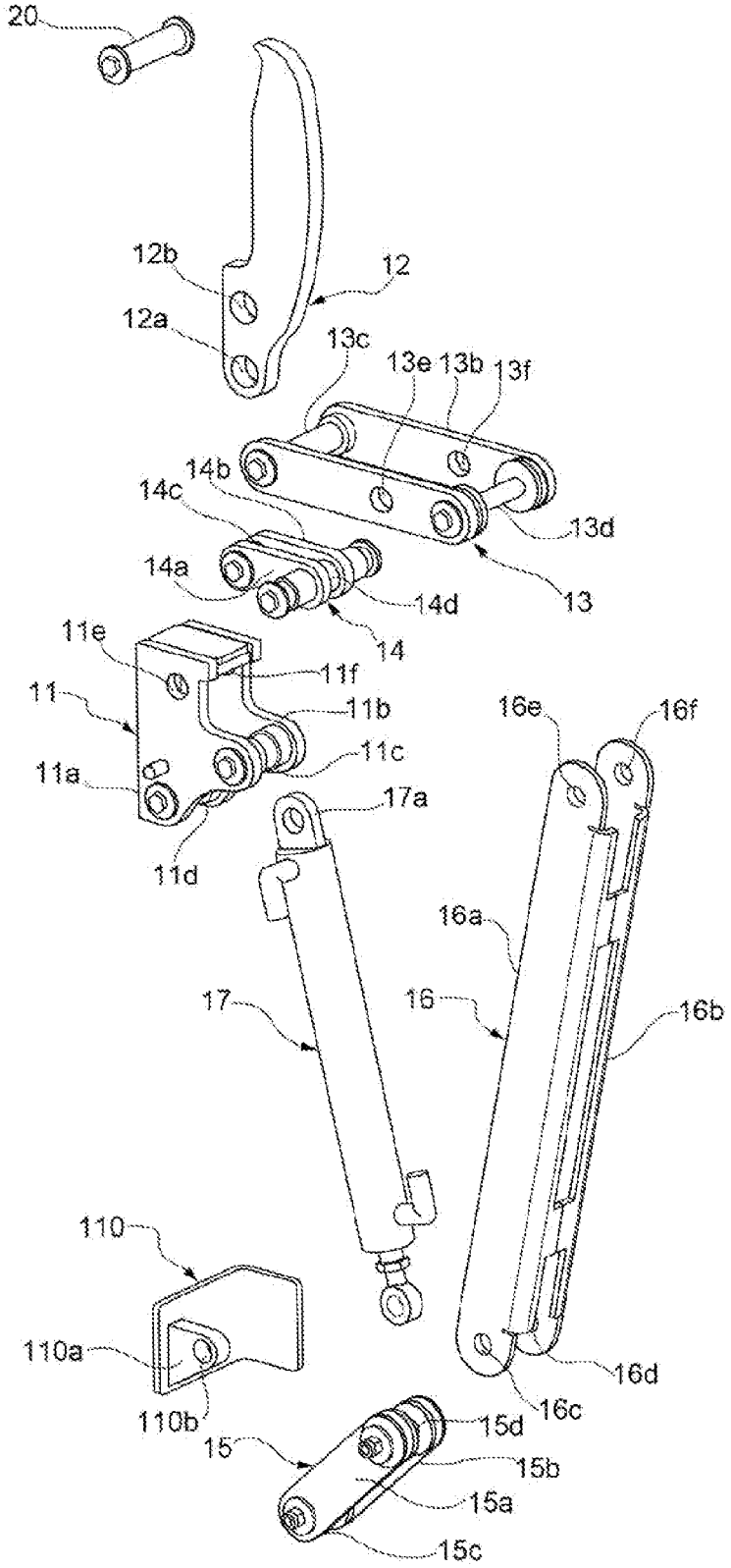
FIG. 2 is an exploded view of the latching device.

With reference to FIG. 2 and the following figures, the latching device 10 comprises a first and a second bracket 11, 110 by means of which the latching device 10 is mounted on the base structure 2 of the platform assembly 1. The first bracket 11 comprises two side pieces 11*a*, 11*b* which are connected together by a first and second hinge pin 11*c*, 11*d*. Respective through-holes 11*e*, 11*f* which are aligned with each other are also formed in the side pieces 11*a*, 11*b*. The second bracket 110 has a projection 110*a* in which a through-hole 110*b* is formed.

A latching element 12 in the form of a hook is hinged together with the first hinge pin 11*c* of the first bracket 11, which is inserted inside a first through-hole 12*a* formed in one end of the latching element 12. The latching element 12 also has a second through-hole 12*b* formed at an intermediate point of the latching element 12.

An actuating lever 13 is hinged with the first bracket 11 via the aligned through-holes 11*e*, 11*f*. The actuating lever 13 comprises two side bars 13*a*, 13*b* which are connected together, at the opposite ends, by means of a first and second hinge pin 13*c*, 13*d*. Respective through-holes 13*e*, 13*f* which are aligned with each other are also formed in the side bars 13*a*, 13*b* at an intermediate point along the bars. The actuating lever 13 is hinged with the first bracket 11 by means of its first hinge pin 13*c* inserted inside the aligned holes 11*e*, 11*f* of the first bracket 11. The side bars 13*a*, 13*b* of the actuating lever 13 are therefore arranged in a position situated laterally further outwards than the side pieces 11*a*, 11*b* of the first bracket.

A link member 14 is hinged, at one end, with the latching element 12 via the through-hole 12*b* and, at the other end, with the actuating lever 13 via the aligned through-holes 13*e*, 13*f*. The link member 14 comprises two side bars 14*a*, 14*b* which are connected together, at the opposite ends, by means of a first and second hinge pin 14*c*, 14*d*. The link member 14 is hinged with the latching element 12 by means of its first hinge pin 14*c* inserted inside the second hole 12*b* of the latching element 12 and with the actuating lever 13 by means of its second hinge pin 14*d* inserted inside the aligned holes 13*e*, 13*f* of the actuating lever 13. The side bars 14*a*, 14*b* of the link member 14 are arranged in a position situated laterally more inwards than the side pieces 11*a*, 11*b* of the first bracket.

A second lever 15 is hinged with the second bracket 110 via the through-hole 110*b*. The second lever 15 comprises two side bars 15*a*, 15*b* which are connected together, at the opposite ends, by means of a first and second hinge pin 15*c*, 15*d*. The second lever 15 is hinged with the second bracket 110 by means of its second hinge pin 15*c* inserted in the through-hole 110*b* of the second bracket 110.

A bar 16 is hinged, at one end, with the second lever 15 by means of the second hinge pin 15*d* and, at the other end, with the actuating lever 13, by means of the second hinge pin 13*d*. The bar 16 comprises two side pieces 16*a*, 16*b* which are connected together and which have, at their opposite ends, respective through-holes 16*c*, 16*d* aligned with each other and respective through-holes 16*e*, 16*f* aligned with each other. The rod 16 is hinged with the second lever 15 by means of the second hinge pin 15*d* of the second lever 15 inserted in the aligned holes 16*c*, 16*d* of the bar 16 and with the actuating lever 13 by means of the second hinge pin 13*d* of the actuating lever 13 inserted in the aligned holes 16*e*, 16*f* of the bar 16. The side pieces 16*a*, 16*b* of the bar 16 are arranged in a position situated laterally more inwards than the side bars 13*a*, 13*b* of the actuating lever 13 and in a position situated laterally more outwards than the side bars 15*a*, 15*b* of the second lever 15.

A linear actuator 17, in the example a hydraulic cylinder, is at its end on the bottom side hinged with the first bracket 11 by means of the second hinge pin 11*d* of the latter and at its end on the rod side is hinged with the second lever by means of the second hinge pin 15*d* of the latter.

The first bracket 11, the latching element 12, the actuating lever 13 and the link member form an articulated quadrilateral, the first bracket 11 of which forms the fixed element or frame.

The first and second brackets 11, 110 which, together with the base structure 2 of the platform assembly 1, constitute a fixed frame, form a second articulated quadrilateral together with the actuating lever 13, the second lever 15 and the bar 16; this second articulated quadrilateral together with the first quadrilateral forms a movement mechanism, by means of which the latching element 12 may be actuated by the linear actuator 17.

A striker element 20 in the form of a pin is arranged fixed together with the platform 3. This striker element 20 is designed to be engaged by the latching element 12 so as to lock the platform 3 against the base structure 2 when the platform 3 is in the raised position.

An electronic control unit (not shown) is provided for controlling the linear actuator 17; a sensor (not shown) is provided for detecting when the platform 3 is in the raised position shown in FIG. 1 and therefore providing an enable signal to the control unit.

Figure 3C:
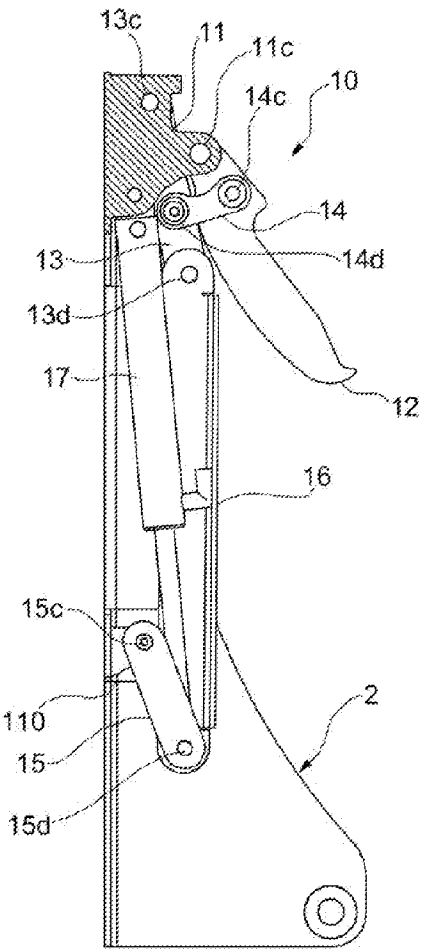
FIGS. 3*a* to 3*c* are a side elevation view, plan view and cross-sectional view of the latching device in an inactive condition.
Figure 3A:
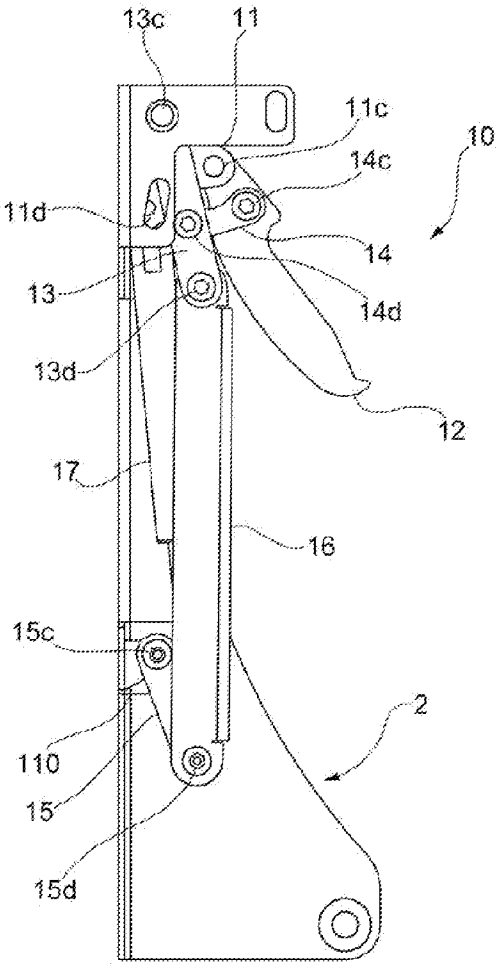
Figure 3B:
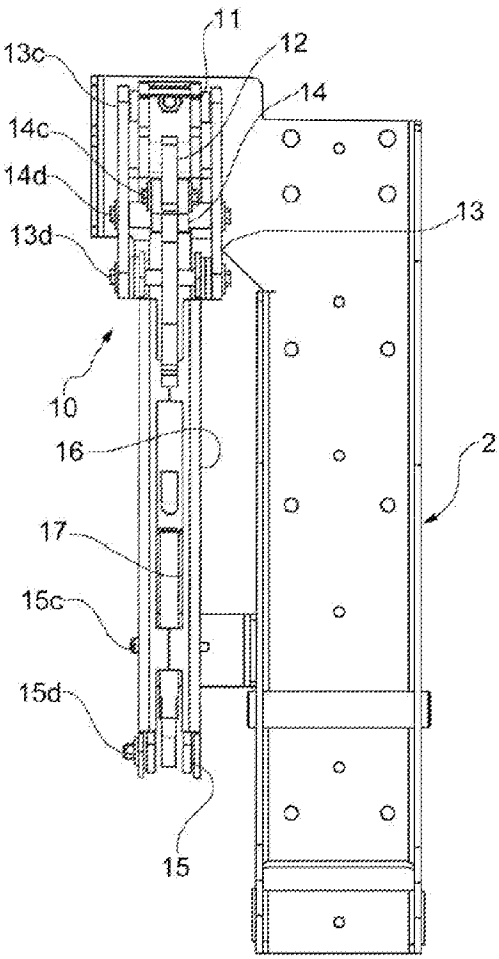
Figure 4C:
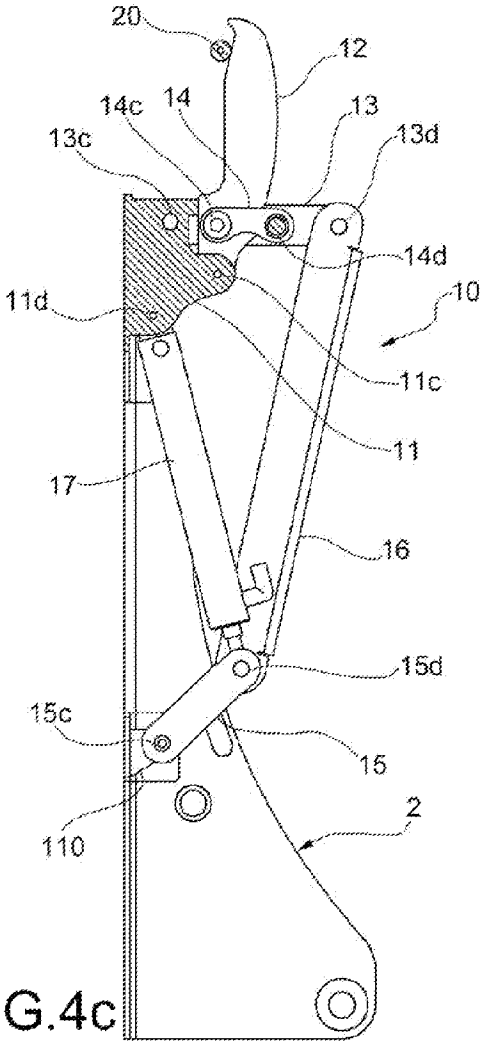
FIGS. 4*a* to 4*c* are a side elevation view, plan view and cross-sectional view, respectively, of the latching device in an active condition.
Figure 4A:
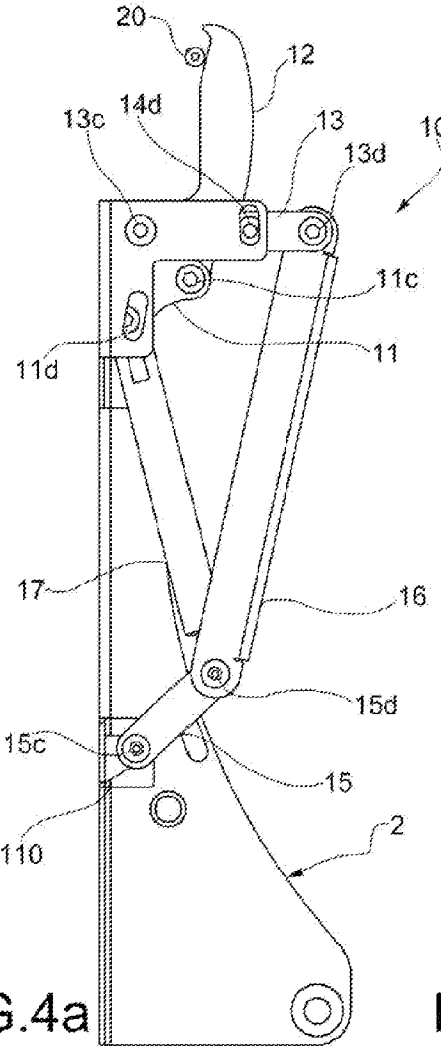
Figure 4B:
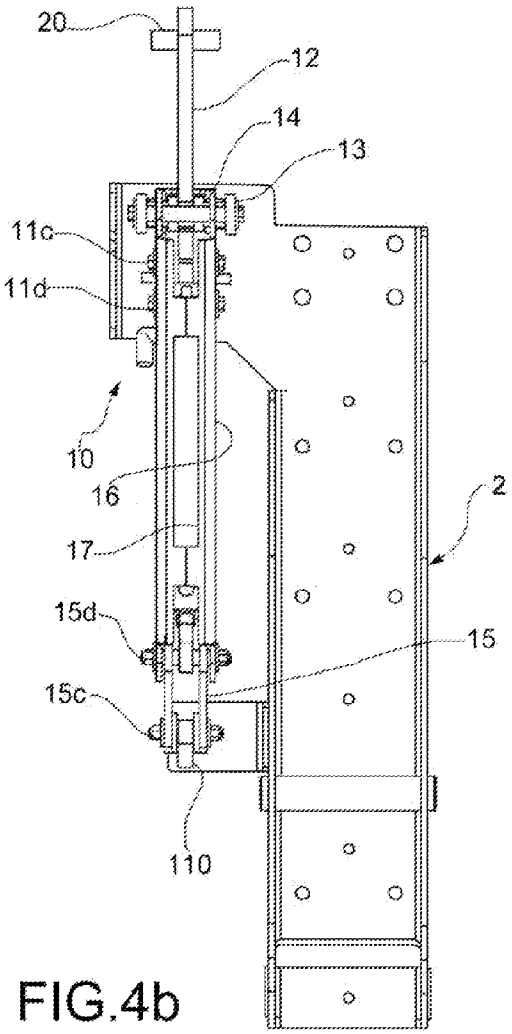

When the system is not locked (FIGS. 3*a*-3*c*), the latching element 12 is located in a low position, so as to allow the movement of the platform 3. During the upwards movement of the platform, when the latter is in the raised position, the sensor sends a signal to the control unit so as to allow locking. The control electronics move the cylinder 17 so that its rod is fully extracted. The movement of the rod of the cylinder 17 causes a rotation of the second lever 15 about its rotation axis; the bar 16, which is hinged with the second lever 15 at one end and with the actuating lever 13 at the other end, is moved; the bar 16 causes the movement of the actuating lever 13 with which the link member 14 is connected. The link member 14 acts on the latching element 12, forcing it to perform a rotational movement about its rotation axis; during this step the latching element 12 presses against the striker element 20 fixed to the platform 20. The movement of the latching element 12 stops when the cylinder 17 reaches the end of its stroke; the entire system is thus located in a stable locking position shown in FIG. 1 and in FIGS. 4*a*-4*c*.

Figure 5:
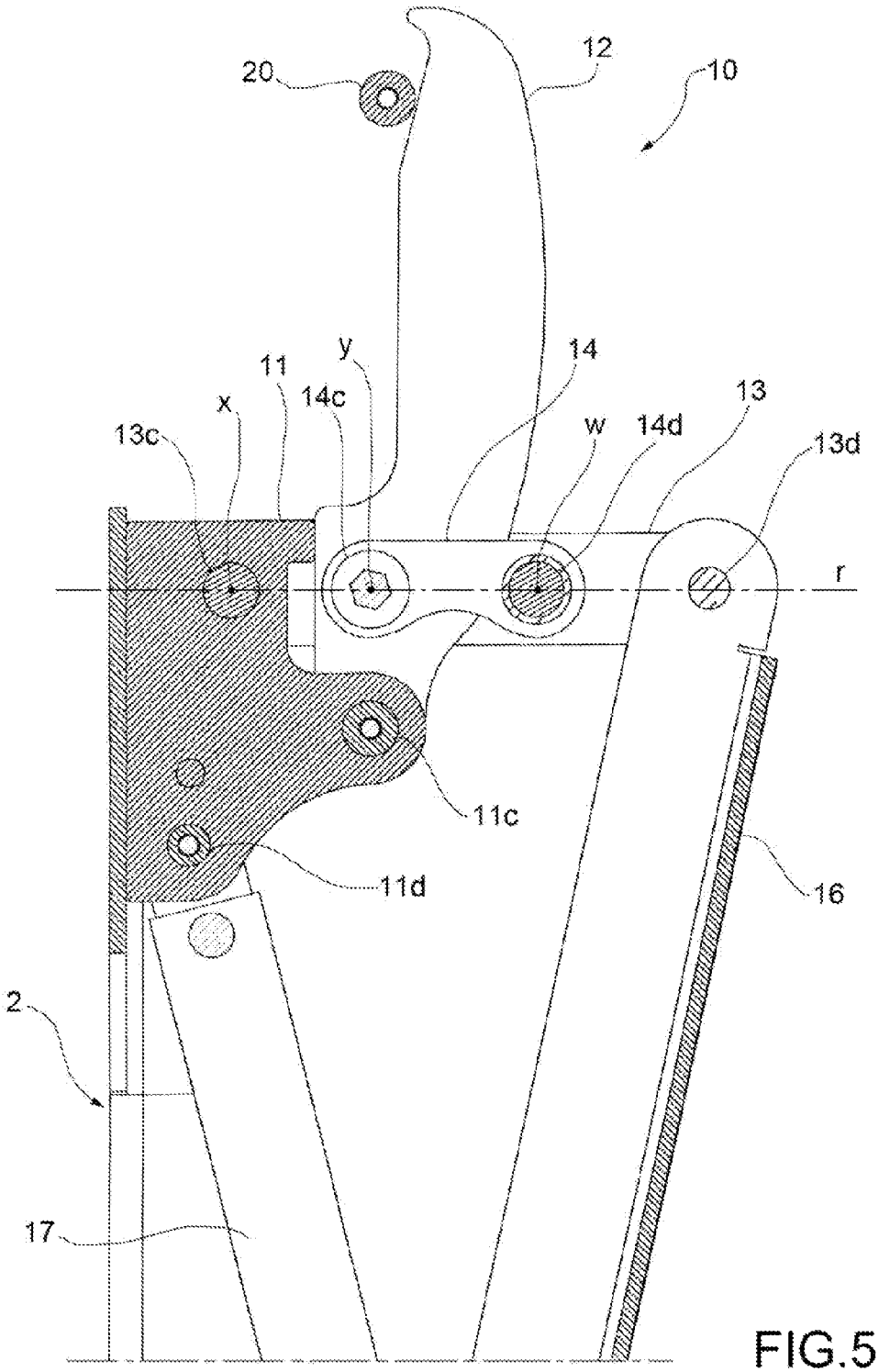
FIG. 5 is a cross-sectional view on a larger scale of the latching device in the active condition.

In this configuration the platform 3 is locked only as a result of the position of the actuating mechanism, without application of an external force, in particular by the actuator, being required. In this position, no external force acting on the platform 3 may vary this condition. In fact, if a force acts on the platform 3 forcing it to move away from the base structure 2 and therefore downwards, the striker element 20 transmits the force to the latching element 12 which tends to rotate about its rotation axis; this movement is prevented by the fact that the link member 14, which should move together with the latching element 12, remains locked owing to the particular situation of the hinge points of the articulated quadrilateral associated therewith, as shown in FIG. 5. In FIG. 5, x, y and w indicate the hinge points between first bracket 11 and actuating lever 13, between link member 14 and latching element 12, and between actuating lever 13 and link member 14, respectively; as can be seen, these hinge points x, y, w lie on a same straight line r coinciding with the direction of movement of the hinge point y between latching element 12 and link member 14 (blocking condition).

The downwards movement of the platform 3 will therefore be possible only by means of actuation of the actuating lever 13 via the bar 16, causing this time the hydraulic cylinder 17 to be extracted.

Preferably, the latching device 10 is arranged so that the latching element 12 is arranged rotatably about a horizontal axis. According to an alternative embodiment it is however possible to arrange the latching device so that the latching element 12 is arranged rotatably about a vertical axis.

According to another embodiment of the invention, the linear actuator consists of an electric or pneumatic actuator. Alternatively, it is possible to provide a rotary actuator instead of the linear actuator.

According to a simplified embodiment of the system the bar 16 is replaced directly by a linear actuator which would act directly on the actuating lever 13.

According to a further simplified embodiment, locking is performed manually and this acts directly or indirectly on the actuating lever 13.

More generally, it is possible to provide a latching device with a different mechanism controlled by the actuator or manually, provided that a stable operating position which acts as locking position is reached.

The invention claimed is:

1. A movable platform assembly comprising a base structure, a platform and an articulated system which connects the platform to the base structure, wherein the platform is movable between a raised position which is horizontally adjacent to the base structure and a lowered position which is horizontally far from the base structure, wherein the assembly includes a latching device switchable into a stable locking position for locking the platform against the base structure when the platform is in the raised position, wherein the latching device comprises a striker element fixed to the platform, a movable latching element arranged on the base structure for engaging the striker element so as to lock the platform, and an actuating mechanism for actuating the latching element, wherein a force applied on the platform when the latching device is in the locking position and tending to horizontally move the platform away from the base structure causes the actuating mechanism of the latching device to be blocked, wherein the latching element is arranged rotatably about a rotation axis, wherein the actuating mechanism comprises an articulated quadrilateral formed by a frame element fixed to the base structure, an actuating lever hinged with the frame element, the latching element hinged with the frame element, and a link member hinged, at opposite ends, with an intermediate point of the latching element and with an intermediate point of the actuating lever, respectively, wherein when the latching device is in locking position the hinge points between frame element and actuating lever, between actuating lever and link member, and between link member and latching element lie on a same straight line coinciding with the instantaneous direction of movement of the hinge point between latching element and link member.

2. The assembly according to claim 1, wherein the rotation axis of the latching element is arranged horizontally.

3. The assembly according to claim 1, further comprising a pneumatic, hydraulic and/or electric actuator connected to the actuating lever for actuating the latching element by means of the actuating mechanism.

4. The assembly according to claim 1, wherein the actuating lever is configured for direct or indirect manual operation so as to actuate the latching element by means of the actuating mechanism.

5. The assembly according to claim 1, wherein the actuating mechanism comprises a second articulated quadrilateral formed by a frame fixed to the base structure, the actuating lever hinged with the frame, a second lever hinged with the frame, and a bar hinged, at opposite ends, with an end of the actuating lever and with an end of the second lever, respectively.

6. The assembly according to claim 5, further comprising a pneumatic, hydraulic and/or electric actuator connected to the second lever for actuating the latching element by means of the actuating mechanism.

* * * * *